US007044124B2

(12) United States Patent
Glass et al.

(10) Patent No.: US 7,044,124 B2
(45) Date of Patent: May 16, 2006

(54) HEATING APPARATUS HAVING INSULATION-CONTACTED FUEL BURNERS

(75) Inventors: Robert S. Glass, Oxnard, CA (US); Gordon W. Stretch, Columbia, SC (US)

(73) Assignee: Rheem Manufacturing Company, New York, NY (US)

( * ) Notice: Subject to any disclaimer, the term of this patent is extended or adjusted under 35 U.S.C. 154(b) by 142 days.

(21) Appl. No.: 10/812,583

(22) Filed: Mar. 30, 2004

(65) Prior Publication Data

US 2005/0217663 A1 Oct. 6, 2005

(51) Int. Cl.
*F24H 1/00* (2006.01)

(52) U.S. Cl. ..... 126/350.1; 122/18.1

(58) Field of Classification Search ..... 126/350.1, 126/357.1, 512, 1 F, 144, 362.1; 122/18.1; 431/354

See application file for complete search history.

(56) References Cited

U.S. PATENT DOCUMENTS 3,756,202 A * 9/1973 Keith ..... 122/156
4,309,165 A * 1/1982 McElroy ..... 431/8
4,418,650 A * 12/1983 Johnson et al. ..... 122/40
4,568,595 A * 2/1986 Morris ..... 428/116
4,709,643 A * 12/1987 Moreno et al. ..... 110/336
5,052,311 A * 10/1991 Kincaid ..... 126/500
5,131,838 A 7/1992 Gensler et al.
5,326,257 A 7/1994 Taylor et al.
5,520,536 A 5/1996 Rodgers et al.
5,945,643 A 8/1999 Casser
5,989,020 A 11/1999 Glass et al.
6,162,045 A 12/2000 Hazard
6,435,140 B1 8/2002 Joyce

FOREIGN PATENT DOCUMENTS

DE 38 30 884 A1 * 3/1990
WO WO 80/00741 A1 * 4/1980

* cited by examiner

*Primary Examiner*—Josiah C. Cocks
(74) *Attorney, Agent, or Firm*—Konneker & Smith, P.C.

(57) ABSTRACT

A fuel-fired heating appliance has multiple premix type fuel burners horizontally disposed in a row in its combustion chamber and operable in a staged manner. The burners are upwardly spaced apart from a rigid fiberboard insulation panel structure extending along the bottom interior side of the combustion chamber. Sandwiched between and contacting the bottom sides of the burners and the top side of the fiberboard panel is a blanket of resilient ceramic fiber insulation material which functions to (1) prevent uncombusted fuel from firing burners from being circulated under non-firing burners, (2) increase the operating temperatures of bottom sides of the burners during firing thereof to lessen thermal stresses in the firing burners, (3) resiliently permit differential thermal expansion of the burners, and (4) reduce harmonic resonance of the burners, and associated operational noise of the appliance, during firing of the burners.

20 Claims, 1 Drawing Sheet

HEATING APPARATUS HAVING INSULATION-CONTACTED FUEL BURNERS

BACKGROUND OF THE INVENTION

The present invention generally relates to heating apparatus and, in an illustrated embodiment thereof, more particularly relates to a fuel-fired heating apparatus having a specially designed staged fuel burner system incorporated therein.

Multiple burner combustion systems are commonly utilized in a variety of fuel-fired heating appliances such as water heaters, pool heaters and boilers. In this type of combustion system, a plurality of mutually spaced apart, parallel, horizontally oriented tubular burners are disposed in a combustion chamber portion of the heating appliance. Each burner is typically of the "premix" type in which, during firing thereof, fuel from a source thereof, and fan-supplied primary combustion air are flowed through the tube to form therein a fuel/air mixture which is discharged through burner outlet openings and combusted without the use of secondary combustion air.

Many multiple burner combustion systems of this type are operated in a "staged" manner in which for low heating loads only some of the burners are fired, with the remaining burners remaining in an unfired state. When the heating load increases, some or all of the remaining burners are also fired to correspondingly increase the heating capability of the appliance. Conventional multiple burner combustion systems of this general type have associated therewith a variety of well known problems, limitations and disadvantages.

For example, when only some of the burners are being fired, uncombusted fuel being discharged from the firing burners tends to undesirably circulate under the unfired burners, and then is discharged from the heating apparatus, resulting in poor overall fuel combustion which is undesirable from an environmental emission standpoint. Further, during firing of a given burner of this type, a substantial temperature differential exists between the (hotter) top side of the burner and its (cooler) bottom side. This temperature difference causes differential longitudinal expansion of the burner during firing, thereby subjecting the burner to a substantial amount of thermal stress during its operation. Additionally, under certain operating conditions, the burners may harmonically resonate—a condition which undesirably increases the operating noise level of the appliance.

As can readily be seen from the foregoing, it would be desirable to provide in a fuel-fired heating appliance a multiple burner combustion system in which the above mentioned burner-related problems, limitations and disadvantages are eliminated or at least substantially reduced.

SUMMARY OF THE INVENTION

In carrying out principles of the present invention, in accordance with an illustrated embodiment thereof, fuel-fired heating apparatus is provided which is representatively a boiler and has a combustion chamber with a bottom interior side portion. A heat exchanger structure horizontally extends through the combustion chamber and is adapted to receive a through-flow of a fluid, such as water, to be heated. A plurality of tubular fuel burners, representatively premix-type gas burners, longitudinally extend horizontally through the combustion chamber in a laterally spaced apart mutually parallel orientation, the burners being positioned below the heat exchanger structure and having bottom side portions spaced upwardly apart from and facing the bottom side portion of the combustion chamber.

The fuel-fired heating apparatus also has control apparatus operative to provide for staged firing of the fuel burners to heat fluid flowing through the heat exchanger structure. A resilient insulation structure is sandwiched between and contacts the bottom interior side portion of the combustion chamber and the bottom side portions of the fuel burners. Preferably, but not by way of limitation, the bottom interior side portion of the combustion chamber is of a relatively rigid insulation material, representatively a fiberboard material, and the resilient insulation structure is representatively a ceramic fiber insulation blanket structure.

In the representatively illustrated embodiment of the fuel-fired heating apparatus, the resilient insulation structure sandwiched between and contacting the bottom sides of the burners and the underlying bottom interior side portion of the combustion chamber provides several desirable functions.

First, during low stage firing of the heating apparatus when only some of the burners are being fired, it substantially blocks migration of uncombusted fuel from the firing burners to the non-firing burners via any portion of the vertical space between the bottom sides of the burners and the bottom interior side portion of the combustion chamber. This lessens the pollution emission level of the heating apparatus.

Second, the sandwiched resilient insulation structure reduces the thermal stress in the burners during firing thereof by elevating the operating temperature of the bottom sides of the burners, which reduces the temperature difference across the burner and reduces differential expansion.

Third, the resilient insulation structure allows differential expansion of the burners without impeding it, thus avoiding additional mechanical stresses in the burner. Specifically, when any of the burners thermally expands in a lateral direction it simply compresses the underlying resilient insulation structure. When the burner later cools and returns to its original lateral dimension, the resilient insulation structure simply expands to its original thickness dimension under the burner to remain engaged therewith.

Fourth, the resilient engagement of the burners by the underlying resilient insulation structure acts as a damper to any harmonic vibrations created in the burners during firing thereof. This, in turn, desirably reduces any operational noise of the fuel-fired heating apparatus.

From at least thermal stress and operational noise reduction standpoints, the disclosed placement of a resilient insulation material in engagement with only a side portion of a fuel burner could also be used to advantage in applications where only a single burner is employed in a fuel-fired heating apparatus. Moreover, principles of the present invention could also be utilized to advantage with burners positioned in non-horizontal orientations and positioned in other locations within a combustion chamber portion of a fuel-fired heating appliance.

It should be noted that while in a preferred embodiment of the present invention a resilient, insulative material is sandwiched between and resiliently contacts the burners and a facing surface portion of the combustion chamber, and is operative to block the flow of uncombusted fuel between the burners and the facing combustion chamber surface portion, the invention could provide some of the above-described advantages without incorporating therein all of the structural and operational features present in the preferred invention embodiment.

For example, if a non-resilient insulation material were to be used, the sandwiched structure would still desirably increase the temperature of a side of the firing burner it contacts. As another example, if a resilient, non-insulative sandwiched structure were to be used, burner operational noise that may occur would still be reduced, and the thermal expansion of the burners during firing thereof would still be resiliently resisted. Also, even if the sandwiched structure did not substantially block the flow of uncombusted fuel between the burners and the facing combustion chamber surface, the sandwiched structure could still provide some or all of the other benefits that it does in the preferred embodiment of the invention.

DETAILED DESCRIPTION

Figure 1:
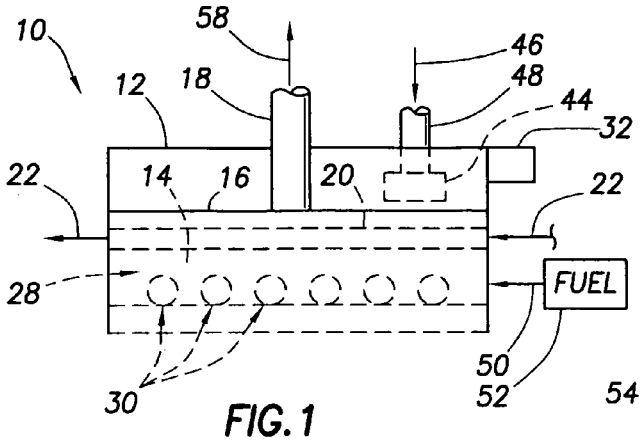
FIG. 1 is a schematic, partially phantomed side elevational view of a fuel-fired heating apparatus having incorporated therein a staged fuel burner system incorporating principles of the present invention.
Figure 2:
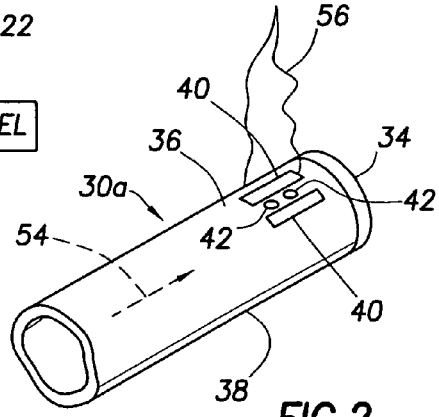
FIG. 2 is a perspective view of a longitudinal portion of one of the fuel burners removed from the heating apparatus.
Figure 3:
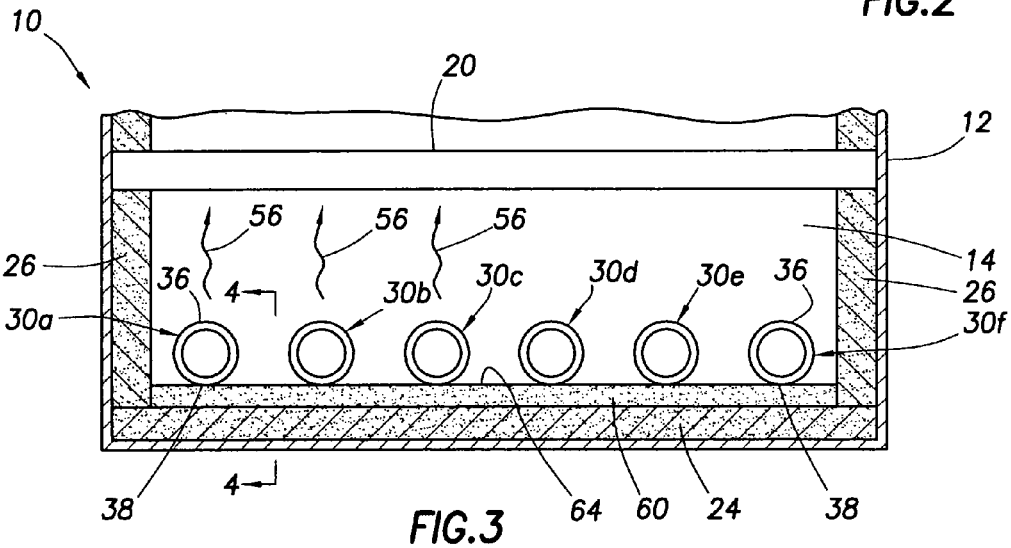
FIG. 3 is an enlarged scale schematic cross-sectional view through a lower portion of the heating apparatus.

Referring initially to FIGS. 1–3, the present invention provides fuel-fired heating apparatus 10 which is representatively a boiler. However, principles of the present invention are not limited to boilers, and could alternatively be incorporated to advantage in a variety of other types of fuel-fired heating appliances such as, for example, water heaters and pool heaters.

As illustrated in FIGS. 1 and 3, the fuel-fired heating apparatus 10 has a metal housing 12 within which a combustion chamber 14 is disposed, the combustion chamber 14 being operatively communicated at its top side 16 with a suitable flue pipe 18. Extending across a top interior portion of the combustion chamber 14 is a heat exchanger structure 20 through which a fluid to be heated, such as water 22, may be suitably flowed. The interior of the combustion chamber 14 is lined with panels, such as bottom panel 24 and side panels 26, of a relatively rigid insulation material, representatively a fiberboard insulation material (see FIG. 3). A fuel burner system 28 is operatively associated with the combustion chamber 14 and is used to heat the water 22 flowing through the heat exchanger structure 20.

The fuel burner system 28 includes a plurality of tubular metal fuel burners 30 (representatively six premix-type gas burners 30*a*–30*f*) which longitudinally extend horizontally through the combustion chamber 14 in a mutually spaced, parallel relationship, and suitable controls 32 permitting a staged firing of the burners 30—for example, firing only the burners 30*a*–30*c* under low fire conditions or firing all or the burners 30*a*–30*f* under high fire conditions. Other firing stage combinations may be alternatively utilized if desired, and there may be a greater or lesser number of burners incorporated in the burner system 28. Both the premix-type burners 30 and the associated burner controls 32 may be of a suitable conventional construction well known to those of ordinary skill in this particular art. As best illustrated in FIG. 3, the burners 30 are spaced downwardly apart from the heat exchanger structure 20, and are also spaced upwardly apart a smaller distance from the top side of the bottom relatively rigid insulation structure 24 within the interior of the combustion chamber 14.

Burners 30 have open inlet end portions (not shown) which are suitably anchored to a vertical wall portion of the combustion chamber 14, and have closed outlet ends 34 (see, for example, the representative burner 30*a* in FIG. 2) and top and bottom body side portions 36,38. Formed in the top side 36 of each burner 30 are fuel/air mixture discharge openings such as slots 40 or outlet holes 42 (or both as representatively shown in FIG. 2). During firing of the heating apparatus 10 a fan portion 44 thereof draws combustion air 46 inwardly through a conduit 48 and forces the air 46 (via a non-illustrated air plenum) into the inlet ends of all of the burners 30*a*–30*f*. Alternately, the blowers can be staged to operate only when the respectively staged burners are operating. At the same time, the controls 32 operate to force fuel 50 (representatively natural gas) from a source 52 thereof inwardly through the inlet ends of the burners 30 which are being fired (for example the burners 30*a*–30*c*).

In each of the firing burners (such as burner 30*a* partially illustrated in FIG. 2) this creates an interior flow 54 therethrough of premixed fuel and air which upwardly exits the top side discharge openings 40 and 42 and is suitably ignited to create burner flames 56 within the combustion chamber 14. The non-firing burners 30 (if any) have only air traversing their interiors. Combustion gases 58 from the burner flames 56 pass upwardly and exteriorly across the heat exchanger structure 20 to heat water 22 being flowed therethrough, and are then discharged upwardly through the flue pipe 18 as shown in FIG. 1.

Figure 4:
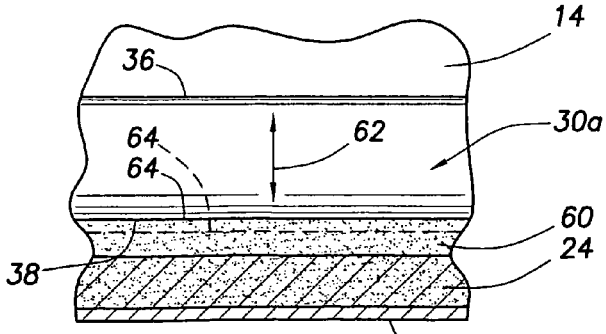
FIG. 4 is an enlarged scale schematic cross-sectional view through the heating apparatus taken along line 4—4 of FIG. 3.

With reference now to FIGS. 3 and 4, in accordance with a key aspect of the present invention, the pollutant discharge level of the heating apparatus 10 is diminished by sandwiching a resilient insulation structure, representatively a blanket 60 of ceramic fiber insulation material, between the bottom sides 38 of the burners 30*a*–30*f* and the top side of the relatively rigid bottom interior insulation structure 24 within the interior of the combustion chamber 14. The ceramic fiber insulation blanket 60 contacts both the bottom sides 38 of the burners 30*a*–30*f* and the top side of the relatively rigid bottom insulation structure 24, and representatively extends along essentially the entire top side of the bottom insulation structure 24.

The sandwiched ceramic fiber insulation blanket 60 serves several functions in the representatively illustrated fuel-fired heating apparatus 10. First, it basically "plugs" the space within the interior of the combustion chamber 14 between the bottom sides 38 of the burners 30*a*–30*f* and the top side of the underlying relatively rigid bottom insulation structure 24. During low fire operation of the heating apparatus 10 in which, by way of non-limiting illustration and example, only the burners 30*a*–30*c* are being fired, this prevents migration of uncombusted fuel from the firing burners 30*a*–30*c* to the non-firing burners 30*d*–30*f* via any portion of the vertical space between the bottom sides 38 of the burners 30*a*–30*f* and the top side of the underlying relatively rigid bottom interior insulation structure 24 within the combustion chamber 14. This substantially lessens the amount of unburned fuel discharged through the flue pipe 18 during low fire operation of the heating apparatus 10, thereby reducing its pollutant emissions.

Second, during firing of any of the burners 30 there exists a substantial temperature differential between its (hotter) top side 36 and its (cooler) bottom side 38. This top-to-bottom temperature differential causes the burner (such as the burner 30*a* depicted in FIG. 2) to thermally expand, as indicated by the double-ended arrow 62 in FIG. 4., thereby subjecting the burner to substantial thermal stress during its firing. However, because a bottom side portion 38 of each burner 30 is contacted by the ceramic fiber insulation blanket 60, during firing of the burner the operating temperature of its bottom side portion 38 is increased, thereby reducing the top-to-bottom temperature differential of the firing burner and correspondingly reducing the differential expansion of the burner. This, in turn, desirably reduces the thermal stress imposed on the burner during firing thereof.

Third, this reduction of thermal stress on each firing burner 30 is achieved without substantially impeding the differential longitudinal expansion (i.e., bowing down) of the burner. When a firing burner 30 expands during firing thereof, as indicated by the double-ended arrow 62 in FIG. 4, the ceramic fiber insulation blanket 60 is simply resiliently compressed between the bottom side 38 of the burner 30 and the underlying relatively rigid insulation structure 24 in a manner moving the top side 64 of the blanket 60 downwardly from its solid line position in FIG. 4 to its dotted line position therein. When the firing of the burner 30 ceases, and the burner 30 cools, the lateral dimension of the burner diminishes and the top side 64 of the ceramic fiber blanket 60 resiliently returns to its solid line burner-engaging position shown in FIG. 4.

Fourth, the resilient engagement of the ceramic fiber insulation blanket 60 with the bottom sides 38 of the burners 30*a*–30*f* acts as a damper to any harmonic vibrations created in the burners during firing thereof. This, in turn, desirably reduces the operational noise of the fuel-fired heating apparatus 10.

As previously mentioned, a greater or lesser number of burners 30 could be utilized in the fuel burner system 28 if desired, and the multiple burners could be grouped for staging purposes in a variety of different manners. Additionally, the disclosed placement of a resilient insulation material in engagement with only a side portion of a fuel burner could also be used to advantage (at least from thermal stress and operational noise reduction standpoints) in applications where only a single burner is employed in a fuel-fired heating apparatus. Further, while the interior of the combustion chamber is representatively lined with a relatively rigid fiberboard insulation material, and the sandwiched insulation material is illustratively a ceramic fiber insulation blanket structure, a variety of other types of resiliently compressible and relatively rigid insulation materials could be alternatively utilized if desired without departing from principles of the present invention. Moreover, principles of the present invention could also be utilized with burners positioned in non-horizontal orientations and positioned in other locations within a combustion chamber.

The foregoing detailed description is to be clearly understood as being given by way of illustration and example only, the spirit and scope of the present invention being limited solely by the appended claims.

What is claimed is:

1. Fuel-fired heating apparatus comprising:

a combustion chamber having a relatively rigid interior side portion;

a fuel burner extending through said combustion chamber in a spaced apart, noncontacting relationship with said interior side portion thereof, said fuel burner having a burner side portion facing said interior side portion of said combustion chamber; and an insulation structure sandwiched between and contacting said burner side portion and said interior side portion of said combustion chamber and preventing contact between said burner side portion and said interior side portion of said combustion chamber in a direction transverse to said interior side portion of said combustion chamber, said insulation structure being resiliently compressible between said burner side portion and said interior side portion of said combustion chamber in response to thermal expansion of said fuel burner, during firing thereof, in said direction transverse to said interior side portion of said combustion chamber.

2. The fuel-fired heating apparatus of claim 1 wherein:

said fuel burner is a premix-type fuel burner.

3. The fuel-fired heating apparatus of claim 1 wherein:

said interior side portion of said combustion chamber is defined by a relatively rigid insulation material.

4. The fuel-fired heating apparatus of claim 3 wherein:

said relatively rigid insulation material is a fiberboard insulation material.

5. The fuel-fired heating apparatus of claim 1 wherein:

said insulation structure is a ceramic fiber insulation blanket.

6. The fuel-fired heating apparatus of claim 1 wherein;

said insulation structure substantially prevents uncombusted fuel flow between said fuel burner and said interior side portion of said combustion chamber.

7. The fuel-fired heating apparatus of claim 1 wherein:

said fuel-fired heating apparatus is a boiler.

8. The fuel-fired heating apparatus of claim 7 wherein:

said boiler is a gas-fired boiler.

9. The fuel-fired heating apparatus of claim 1 wherein:

said fuel burner is a first fuel burner, said heating apparatus further comprises a second fuel burner extending through said combustion chamber in a spaced apart relationship with said first fuel burner, and said first and second fuel burners are operable in a staged manner.

10. The fuel-fired heating apparatus of claim 1 wherein:

said fuel burner is a gas burner.

11. Fuel-fired heating apparatus comprising:

a combustion chamber having a relatively rigid bottom interior side portion;

a heat exchanger structure horizontally extending through said combustion chamber and being adapted to receive a through-flow of a fluid to be heated;

a plurality of tubular fuel burners longitudinally extending horizontally through said combustion chamber in a laterally spaced apart mutually parallel orientation, said fuel burners being positioned below said heat exchanger structure and being positioned above said bottom interior side portion of said combustion chamber in a noncontacting relationship therewith, said plurality of tubular fuel burners having bottom side portions facing said bottom interior side portion of said combustion chamber; and a resilient insulation structure sandwiched between and contacting said bottom interior side portion of said combustion chamber and said bottom side portions of said fuel burners and preventing contact between said burner side portions and said interior side portion of said combustion chamber in a direction transverse to said interior side portion of said combustion chamber, said resilient insulation structure being resiliently compressible by differential thermal expansion of said fuel burners, during firing thereof, in said direction transverse to said interior side portion of said combustion chamber.

12. The fuel-fired heating apparatus of claim 11 wherein: said fuel-fired heating apparatus is a boiler.

13. The fuel-fired heating apparatus of claim 11 wherein: said fuel burners are gas burners.

14. The fuel-fired heating apparatus of claim 11 wherein: said fuel burners are premix-type fuel burners.

15. The fuel-fired heating apparatus of claim 11 wherein: said bottom interior side portion of said combustion chamber is defined by a relatively rigid insulation material.

16. The fuel-fired heating apparatus of claim 15 wherein: said relatively rigid insulation material is a fiberboard material.

17. The fuel-fired heating apparatus of claim 11 wherein: said resilient insulation material is an insulation blanket structure.

18. The fuel-fired heating apparatus of claim 17 wherein: said insulation blanket structure is a ceramic fiber material.

19. The fuel-fired heating apparatus of claim 11 wherein: said resilient insulation structure substantially prevents flow of uncombusted fuel from firing burners through any portion of the vertical space between said fuel burners and said bottom interior side portion of said combustion chamber.

20. The fuel-fired heating apparatus of claim 19 wherein: said bottom interior side portion of said combustion chamber is defined by a relatively rigid fiberboard insulation material, and said resilient insulation material is a ceramic fiber insulation blanket structure.

* * * * *